US005425185A

United States Patent [19]

Gansler

[11] Patent Number: 5,425,185

[45] Date of Patent: Jun. 20, 1995

[54] SHOE WITH A SIDE MOUNTED CENTRAL ROTARY CLOSURE

[75] Inventor: Martin Gansler, Gersthofen, Germany

[73] Assignee: Tretorn AB, Helsingborg, Sweden

[21] Appl. No.: 249,359

[22] Filed: May 27, 1994

[30] Foreign Application Priority Data

May 28, 1993 [DE] Germany ..... 9307857 U

[51] Int. Cl.[6] ..... A43B 11/00

[52] U.S. Cl. ..... 36/50.1; 36/50.5

[58] Field of Search ..... 36/88, 89, 91, 92, 50.1, 36/50.5; 24/713, 712.1

[56] References Cited

U.S. PATENT DOCUMENTS

| | | | |
|---|---|---|---|
| 1,328,333 | 1/1920 | Mann | 36/50.1 |
| 4,130,949 | 12/1978 | Seidel | 36/50.1 |
| 4,282,659 | 8/1981 | Borque et al. | 36/50.1 |
| 4,577,419 | 3/1986 | Chassaing . | |
| 4,624,064 | 11/1986 | Pozzebon | 36/50.5 |
| 4,972,613 | 11/1990 | Loveder | 36/50.1 |
| 5,205,055 | 4/1993 | Harrell . | |
| 5,341,583 | 8/1994 | Hallenbeck | 36/50.1 |

FOREIGN PATENT DOCUMENTS 9000954 6/1991 WIPO .

*Primary Examiner*—David T. Fidei

*Assistant Examiner*—Marie Denise Patterson

*Attorney, Agent, or Firm*—Sixbey, Friedman, Leedom & Ferguson; David S. Safran

[57] ABSTRACT

A shoe has an upper made of resiliently flexible materials, a central rotary closure arranged on a lateral side of the upper in an area in which the lateral malleolus of a wearer's foot is received, at least one tightening element connected to the central rotary closure, the at least one tightening element having a front tightening section which extends forwardly from the central rotary closure and a rear tightening section which extends rearwardly from the central rotary closure, and front and rear pull straps. The front pull strap is coupled to the front tightening section and runs obliquely forward therefrom over an instep area of the upper to an end thereof which is fastened to the upper. The rear tightening section is coupled with the rear pull strap, and the rear pull strap runs rearwardly therefrom, around a heel portion of the upper to a medial side of the shoe where, preferably, it passes over a guide element on the upper and then extends obliquely forward therefrom over the instep area of the upper to an end thereof which is fastened at the lateral side of the shoe. By this construction, the central rotary closure is able to close the shoe by shortening the tightening element and open the shoe by increasing the free length of the tightening element by applying and releasing tension on the pull straps.

18 Claims, 2 Drawing Sheets

SHOE WITH A SIDE MOUNTED CENTRAL ROTARY CLOSURE

BACKGROUND OF THE INVENTION

1. Field of the Invention

This invention relates to a shoe, especially an athletic shoe, with a central rotary closure which is provided on an instep cover, and a tightening element that can be drawn in and let out by the central rotary closure and is guided from the instep cover laterally and is looped over deflecting elements of guide elements that are located in the area of the side parts of the upper.

2. Description of Related Art

Shoes of the type to which the present invention is directed are known, for example, from U.S. Pat. Nos. 5,117,567 and 5,181,331. In the shoes described therein, the central rotary closure is attached to an instep cover, to which lateral closing flaps, for side parts of the upper, are molded-on in a hinged manner. The tightening element that can be tightened with the central rotary closure runs from the instep cover alternately over guide elements of the closing flaps and the instep cover.

Further, it is known from one embodiment of the previously mentioned patents and from U.S. Pat. No. 5,177,882 to make the closing flaps as separate parts from the instep cover. In this case, the guide elements are attached to lateral straps which run over the shoe upper to the area of the shoe sole and which connect to the closing flaps via corresponding recesses formed in the closing flaps.

Also, allowed, commonly owned, co-pending U.S. patent application 08/064,664, filed May 21, 1993 describes a shoe having a central closure which is mounted on the upper in the vicinity of the ankle bone area thereof. In the case of the shoe of this application, the tightening element runs from the central closure to guide elements on the instep cover and then runs alternately over guide elements of the closing flaps and the instep cover with one end portion of the tightening element passing around the heel of the shoe above the heel bone back to a point of attachment with or near the central rotary closure. This arrangement is particularly suited for shoes with high top type uppers as are most commonly found on basketball shoes.

SUMMARY OF THE INVENTION

The primary object of this invention is to achieve shoes of the aforementioned type which, in the case of stress on the instep, for example, by the impact of a ball or the like, will avoid an accidental opening of the shoe.

It is a further object of the invention to enable the production and assembly of the closing device to be possible in a simple way.

These objects and others are achieved by preferred embodiment of the invention in which the central rotary closure is arranged on the lateral side of the shoe in the area surrounding the lateral malleolus, and one tightening section of a tightening element runs forward from the central rotary closure and another tightening section is directed to the rear are formed on same side of the shoe. Furthermore, the front tightening section is coupled with a pull strap which runs forward obliquely over the instep and is fastened at an end to the shoe upper, especially to the medial side of the shoe. A rear tightening section of the tightening element is coupled with a pull strap which runs to the rear and around the heel to the medial side of the shoe, and optionally, around a guide element and then obliquely forward over instep. Optionally, from its connection to the front tightening section, the pull strap crosses over the instep and is fastened at a lower end area indirectly or directly to the lateral side of the shoe on shoe upper.

By the arrangement of the central rotary closure outside of the instep stress zone in the area of the lateral malleolus and by the closing action of the tightening element starting from the central rotary closure, on the one hand, to the rear around the heel forward over the instep again to the outside of the shoe, as well as, on the other hand, forward over the instep to the opposite inside of the shoe, an advantageous and finely adjustable closing action is achieved. As a result, at the same time, an accidental opening, in the case of otherwise possible stressing of the central rotary closure is avoided.

These and further objects, features and advantages of the present invention will become apparent from the following description when taken in connection with the accompanying drawings which, for purposes of illustration only, show a single embodiment in accordance with the present invention.

DETAILED DESCRIPTION OF THE PREFERRED EMBODIMENT

Figure 1:
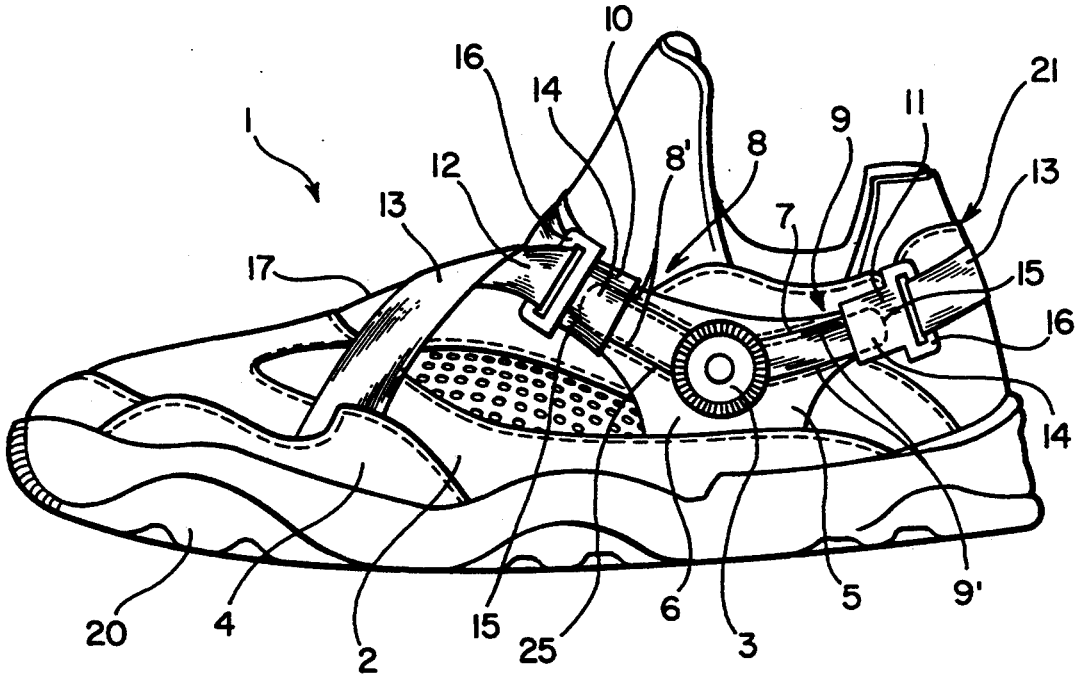
FIG. 1 is a side view of the lateral side of a shoe according to a preferred embodiment of the invention.
Figure 2:
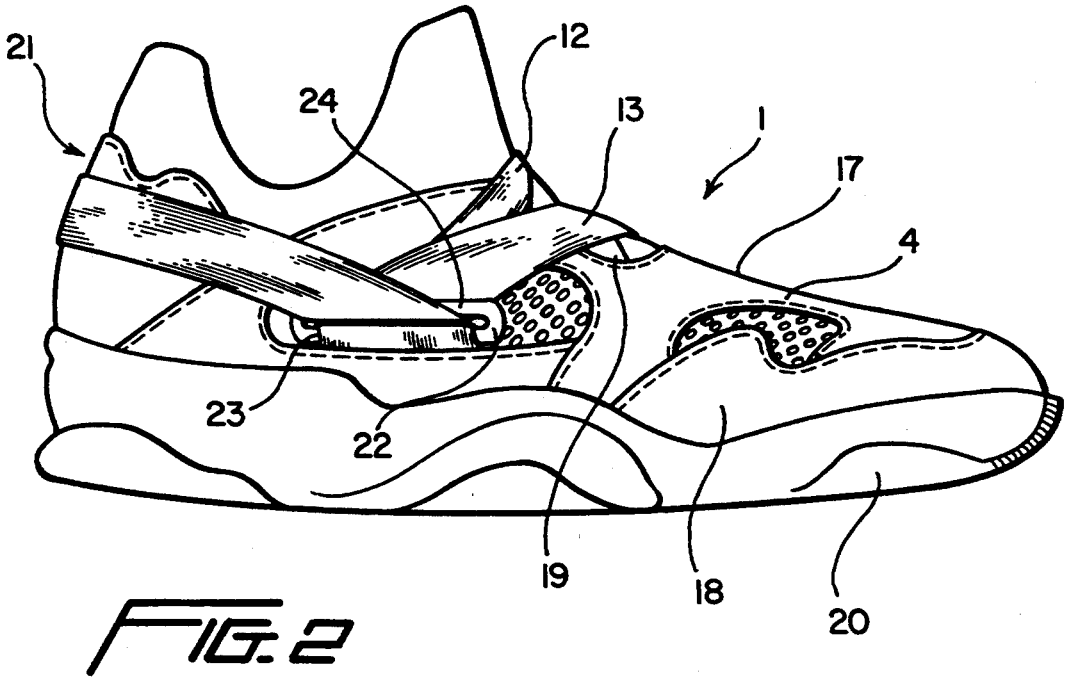
FIG. 2 is a side view of the medial side of the shoe shown in FIG. 1.

A shoe 1, especially a sport or leisure shoe of the type having an upper 4 formed of elastically flexible materials, such as fabrics, leather, etc., has a central rotary closure 3 mounted on the outer side 2 of the shoe, i.e., on the side of the lateral malleolus, in the area surrounding the lateral malleolus. The closure 3 can correspond to a known design of the type used in the initially mentioned patents and application which has a quick release. The central rotary closure is attached, for example, directly to the material of upper 4 of shoe 1, preferably, being fastened, as in the embodiment according to FIG. 1, to a special support plate 5, which is fixed, for example, stitched at its lower edge 6, to the upper of shoe 1.

A tightening element 7, for example, a plastic or metal wire rope, is coupled with the central rotary closure 3 in a way known in the art so that it can be shortened to close the shoe and lengthened to open it by rotating a winding knob or disc of the rotary closure 3. The quick release can take place by pulling or pressing on the winding knob or disc.

Tightening element 7 is guided so that a front tightening section 8 and a rear tightening section 9 are formed. Tightening sections 8, 9, preferably, are in the form of loops 8', 9' and are each coupled with a respective one of a pair of pull straps 12, 13, either directly or preferably by coupling elements 10, 11. For this purpose, coupling elements 10, 11 have a guide element 14 formed with a circular or elliptical path or other form of guideway running in a suitable way, for example, a guiding groove 15, in which or around which a respective one of tightening sections 8, 9 is guided. By rotating central rotary closure 3 and shortening tightening element 7, coupling elements 10, 11 can be pulled toward central rotary closure 3, while releasing of the rotary closure 3 allows the tightening element to be unwound, so that the coupling elements 10, 11 can be moved away from the rotary closure 3 as the free length of the tightening element 7 increase as a result.

Figure 3:
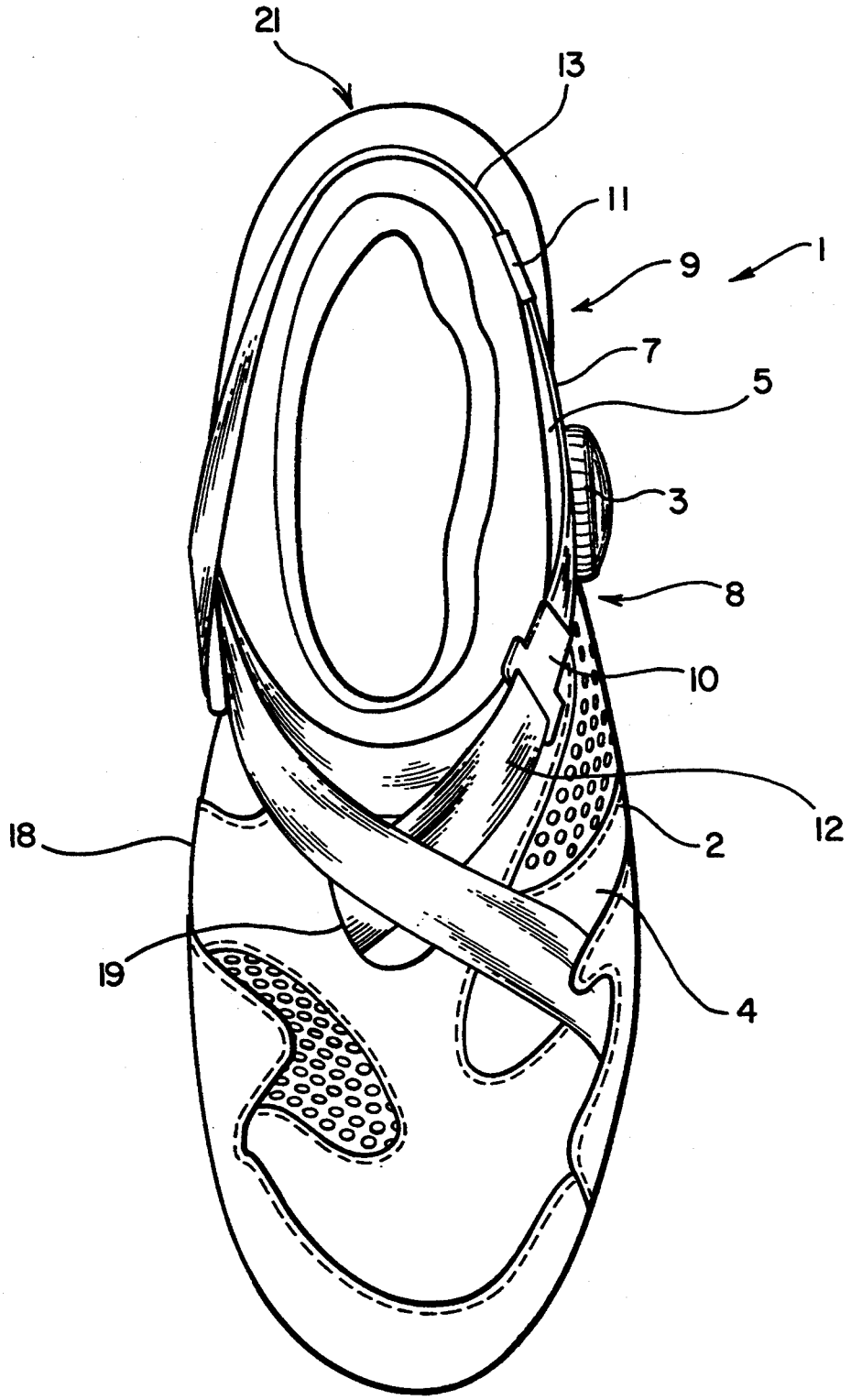
FIG. 3 is a top view of the shoe according to FIGS. 1 and 2.

Pull strap 12 can be fastened to front coupling element 10 or guided around a deflecting bar 16 of it, and from deflecting bar 16, pull strap 12 is guided forward over instep 17 toward the inner side of the shoe, i.e., to the side of the medial malleolus, where it is fastened at its end 19 (FIG. 3). When using the deflecting bar 16 as a guide instead of a fastening point, the pull strap 12, after passing around bar 16, runs first slightly forward and then upward directly over instep 17 (in FIG. 3 this portion of strap 12 is shown as being initially partially covered by the portion of strap 12 running from end 19 to coupling 10 and then partially covered the portion of strap 13 running over the instep 17). After crossing over instep 17, the pull strap 13 runs rearward and downward into the area of the ankle or of the inner malleolus where it is fastened to upper 4, preferably relatively close to the sole 20 or directly to sole 20.

Rear coupling element 11 preferably also has a deflecting bar 16, to which pull strap 13 is fastened. Pull strap 13 runs to the rear around the heel 21, then forwardly along the medial side 18 of the shoe, over the instep 17 to the lateral side 2 of the shoe, where it is fastened. In this case, two pull straps 12 and 13 can cross over instep 17.

To achieve a good closing action, pull strap 13 is guided, preferably, from heel 21, first, over a deflecting bar of a slotted guide element 22 which is between the arch of the foot and the inner malleolus, especially in the area forward of the lateral malleolus. Preferably, guide element 22 is provided on upper 4 or on sole 20 in the area below the lower edge of the inner malleolus. As a result, pull strap 13 runs from the heel 21, first, forward and downward, and after deflection, forward and upward over instep 17. As a result, a good supporting of the foot in the shoe 1 is assured.

Advantageously, guide element 22 has a pin-shaped or rod-shaped portion which, preferably, runs horizontally or inclined at a small angle to a horizontal line and over which strap 13 passes. Advantageously, the guide element 22 is designed as a ring or especially as an elongated link, one longitudinal section 23 of which is fastened to shoe 1, for example to upper 4 or to sole 20 and the other longitudinal section 24 of which pull strap 13 is guided.

To guide tightening element 7, support plate 5 can be provided with guideways 25 formed, for example, as grooves. The guideways can also, at least partially, be pipe-shaped or tunnel-shaped to enclose the portions of the tightening element 7 passing therethrough.

While a single embodiment in accordance with the present invention has been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Shoe comprising an upper made of resiliently flexible materials, a central rotary closure arranged on a lateral side of the upper in an area in which the lateral malleolus of a wearer's foot is received, at least one tightening element connected to the central rotary closure, the at least one tightening element having a front tightening section which extends forwardly from the central rotary closure and a rear tightening section which extends rearwardly from the central rotary closure, and front and rear pull straps; wherein the front pull strap is coupled to said front tightening section and runs obliquely forward therefrom over an instep area of the upper to an end thereof which is fastened to the upper; wherein said rear tightening section is coupled with the rear pull strap, said rear pull strap running rearwardly therefrom, around a heel portion of the upper to a medial side of the shoe; and wherein said central rotary closure forms a means for shortening the tightening element by rotating the central rotary closure to close the shoe and as a means for lengthening the tightening element to open the shoe by applying and releasing tension on the pull straps.

2. Shoe according to claim 1, wherein said end of the forward pull strap is connected to the upper at the medial side of the upper; wherein the rear pull strap extends around a guide element at the medial side of the upper and extends obliquely forward therefrom over the instep area of the upper to an end thereof which is fastened at the lateral side of the shoe.

3. Shoe according to claim 2, wherein said rear pull strap crosses the forward pull strap in an area where they pass over the instep area of the upper.

4. Shoe according to claim 1, wherein at least one of said front and rear tightening sections is coupled with the respective one of the front and rear pull straps by a respective coupling element.

5. Shoe according to claim 4, wherein said at least one of the front and rear tightening sections is formed into a loop; and wherein the coupling element has a guide element over which said loop is guided.

6. Shoe according to claim 4, wherein the front pull strap runs from said end thereof, over the instep area, around a deflecting element of the coupling element by which it is coupled to the front tightening section and then back over the instep area to the medial side wherein a second end thereof is fastened.

7. Shoe according to claim 6, wherein the guide element for the rear pull strap at the medial side of the upper is located in an area forward of that at which the medial malleolus of the wearer is received.

8. Shoe according to claim 5, wherein the guide element at the medial side of the upper has an at least generally horizontally oriented pin-shaped or rod-shaped portion over which the rear pull strap passes.

9. Shoe according to claim 8, wherein said pin-shaped or rod-shaped portion of the guide element is formed by a longitudinally extending section of an elongated link around which the rear pull strap is guided, a second longitudinally extending section of the elongated link being fastened to the shoe.

10. Shoe according to claim 1, wherein the central rotary closure is fastened to the upper.

11. Shoe according to claim 10, wherein central rotary closure is fastened to the upper by a support plate.

12. Shoe according to claim 11, wherein the support plate is fastened to the upper near a lower edge thereof.

13. Shoe according to claim 12, wherein the support plate is provided with guideways for the at least one tightening element.

14. Shoe according to claim 13, wherein the guideways enclose the portions of the at least one tightening element.

15. Shoe according to claim 2, wherein the guide element for the rear pull strap at the medial side of the upper is located in an area forward of that at which the medial malleolus of the wearer is received.

16. Shoe according to claim 2, wherein the front pull strap runs from said end thereof, over the instep area, around a deflecting element of the coupling element by which it is coupled to the front tightening section and then back over the instep area to the medial side wherein a second end thereof is fastened.

17. Shoe according to claim 2, wherein at least one of said front and rear tightening sections is coupled with the respective one of the front and rear pull straps by a respective coupling element.

18. Shoe according to claim 17, wherein said at least one of the front and rear tightening sections is formed into a loop; and wherein the coupling element has a guide element over which said loop is guided.

* * * * *